US005197726A

United States Patent [19]

Nogami

[11] Patent Number: 5,197,726

[45] Date of Patent: Mar. 30, 1993

[54] SHEET FEEDER

[75] Inventor: Yutaka Nogami, Kanagawa, Japan

[73] Assignee: Fuji Xerox Co., Ltd., Tokyo, Japan

[21] Appl. No.: 896,382

[22] Filed: Jun. 10, 1992

[30] Foreign Application Priority Data

Sep. 26, 1991 [JP] Japan ..... 3-274634

[51] Int. Cl.[5] ..... B65H 3/06

[52] U.S. Cl. ..... 271/110; 271/270

[58] Field of Search ..... 271/110, 111, 270

[56] References Cited

U.S. PATENT DOCUMENTS 5,043,771 8/1991 Shibata ..... 271/270 X
5,112,038 5/1992 Dunaway ..... 271/111 X

FOREIGN PATENT DOCUMENTS 60-77051 5/1985 Japan .
61-51428 3/1986 Japan .
62-136442 6/1987 Japan .

*Primary Examiner*—Richard A. Schacher

*Attorney, Agent, or Firm*—Finnegan, Henderson, Farabow, Garrett and Dunner

[57] ABSTRACT

A sheet feed tray on which sheets are stored, a feed member for feeding out sheets one at a time from the sheet feed tray, a separating member for separating sheets when a plurality of sheets are fed out at a time from the sheet feed tray by the feed member, to feed the sheets one at a time, a transporting member for transporting the sheet delivered from the separating member to a image forming member, a sheet detecting member for detecting the passage of the leading edge of the sheet past a first position in the transporting member, a calculation member which, based on the behavior of a sheet which is fed by the feed member, but is then detained by the separating member, determines a target time at which a sheet should arrive at a second position downstream of said first position, and calculates from the detection result provided by the sheet detecting member the deviation from said target time of the sheet, and control member for varying the sheet transport speed on the basis of the results of calculation made by the calculation member so that the sheet arrives at the second position at the preset desired time.

10 Claims, 8 Drawing Sheets

[FIG. 1]
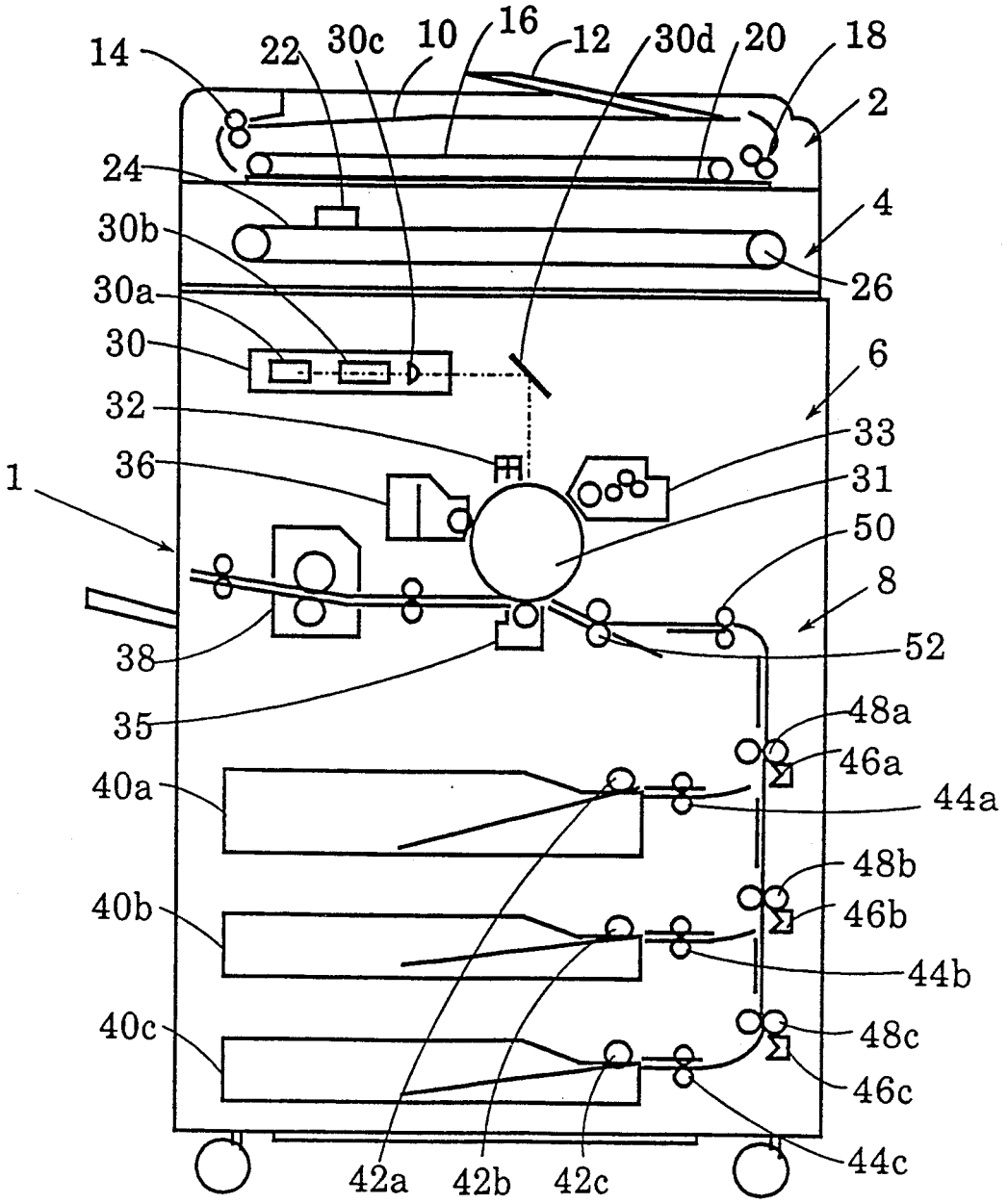

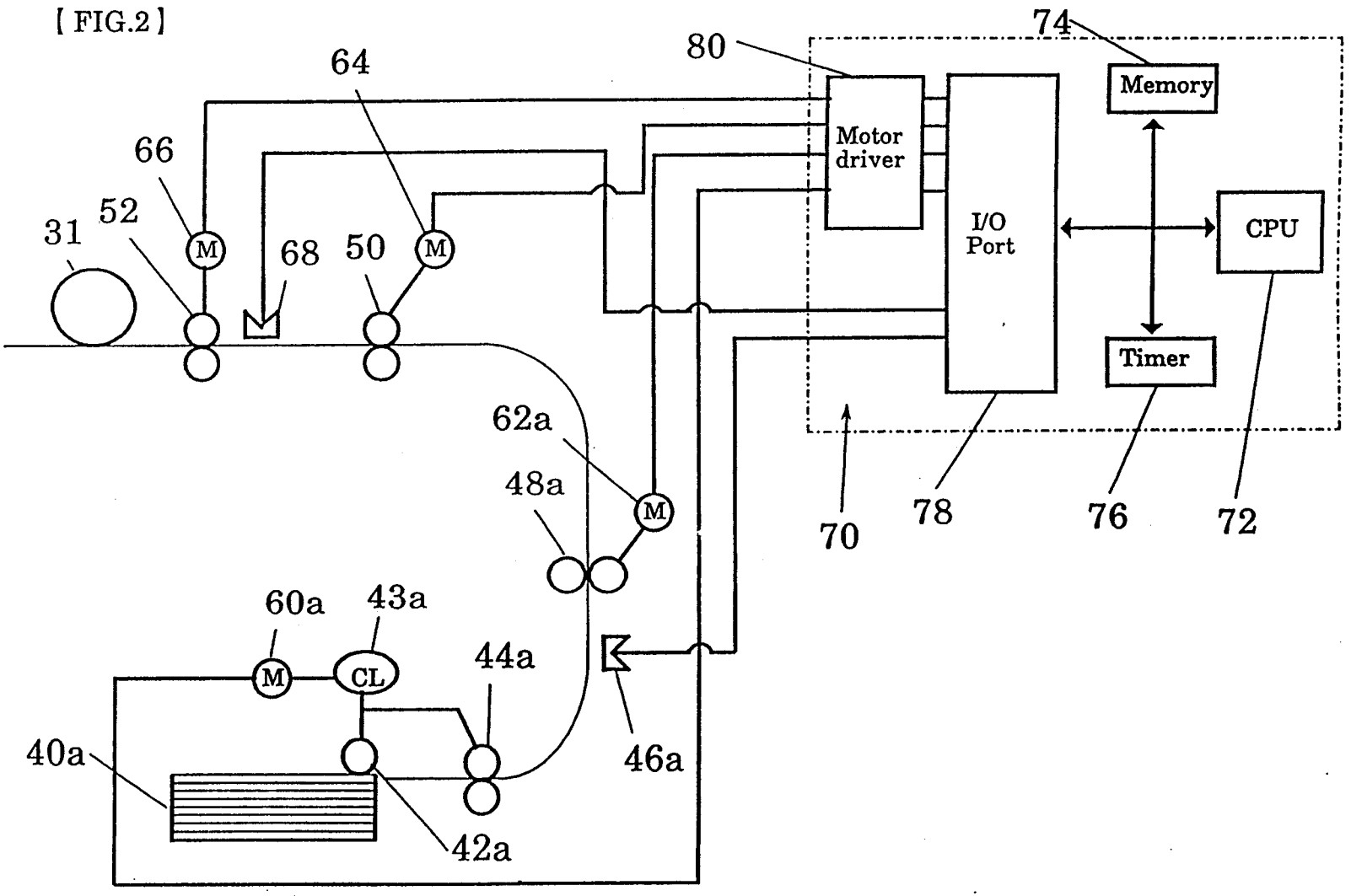
[ FIG.2 ]

[ FIG.3 ]
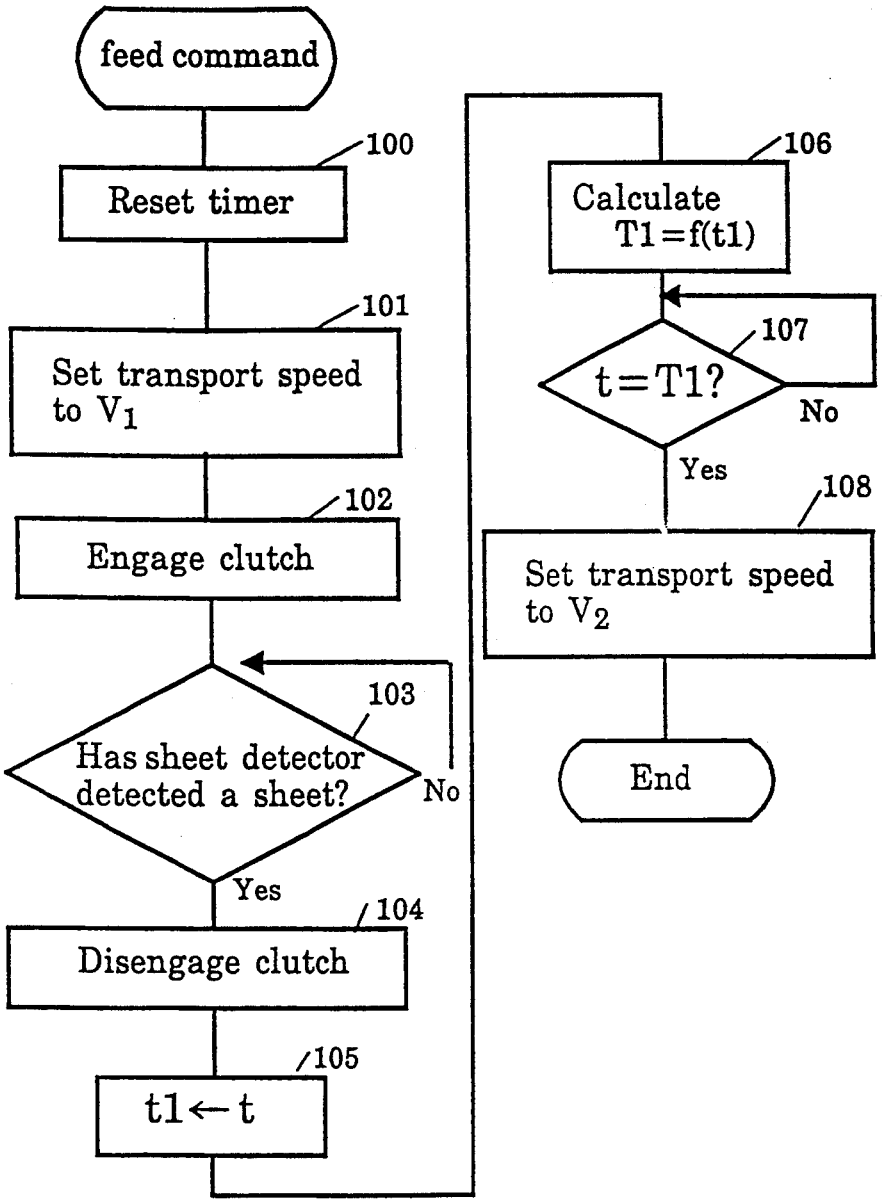

[ FIG4 ]
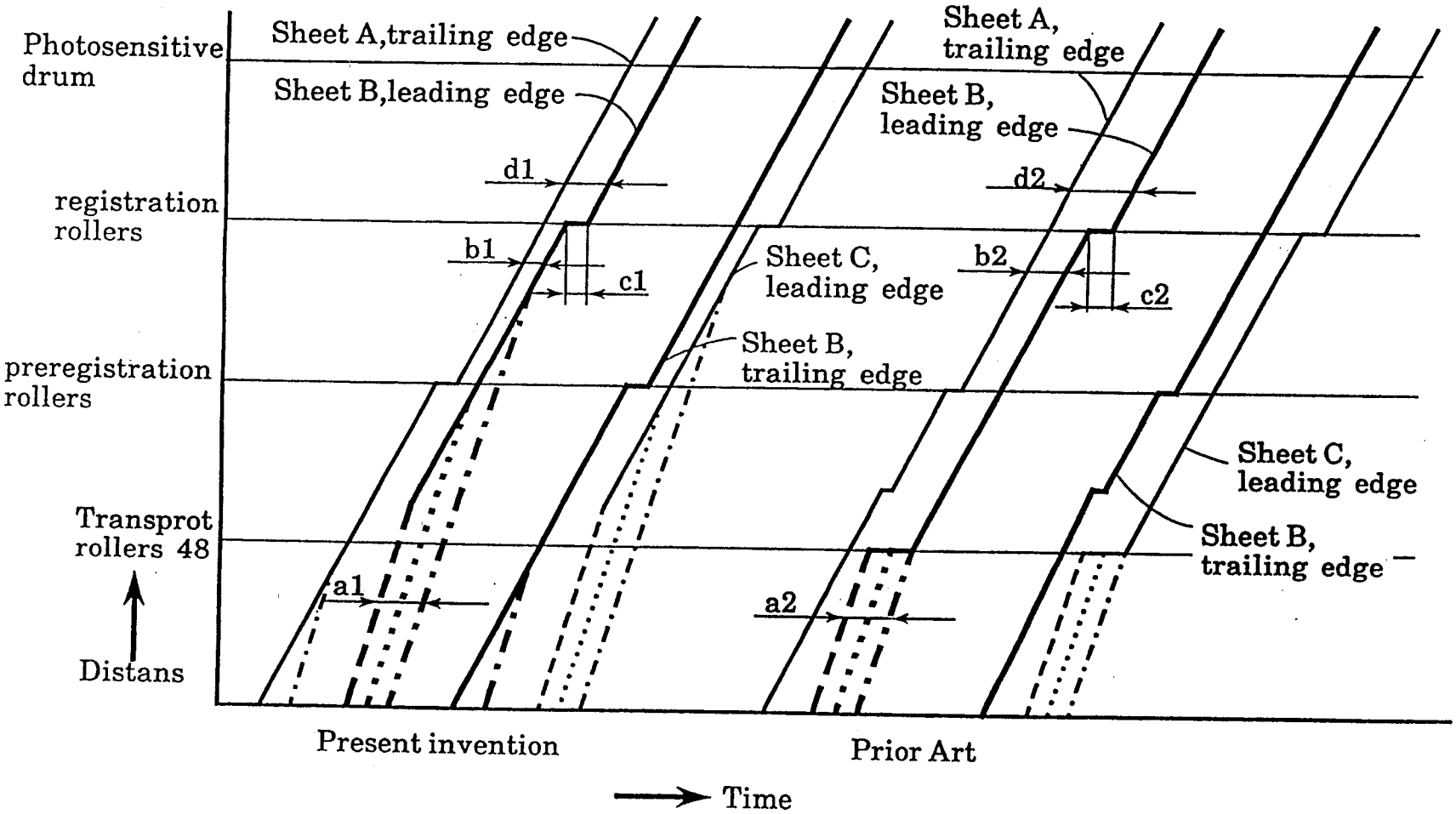

[ FIG.5 ]
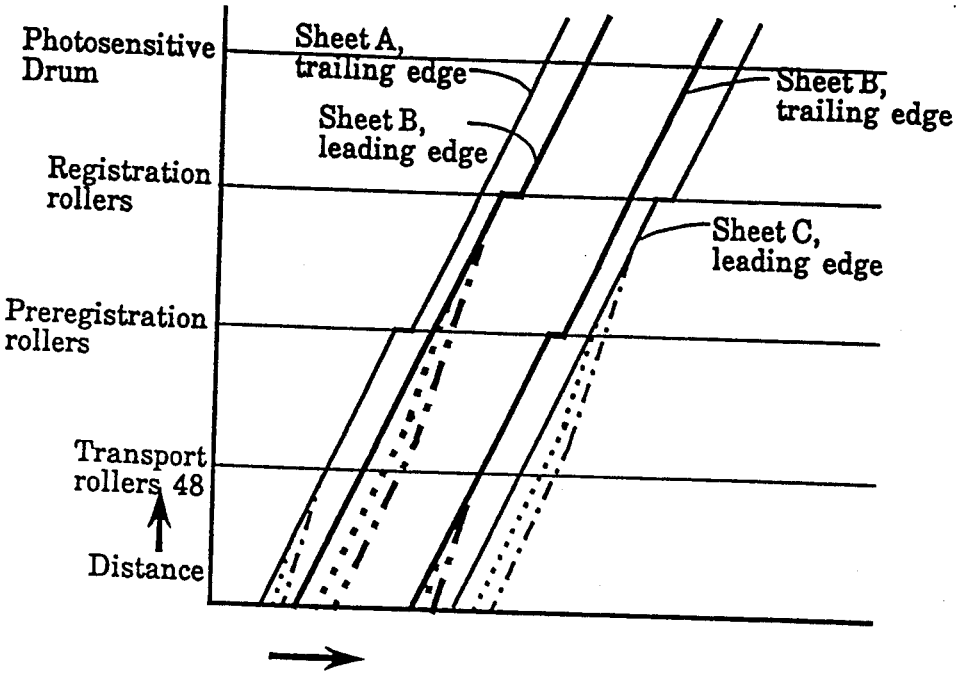
[ FIG.6 ]
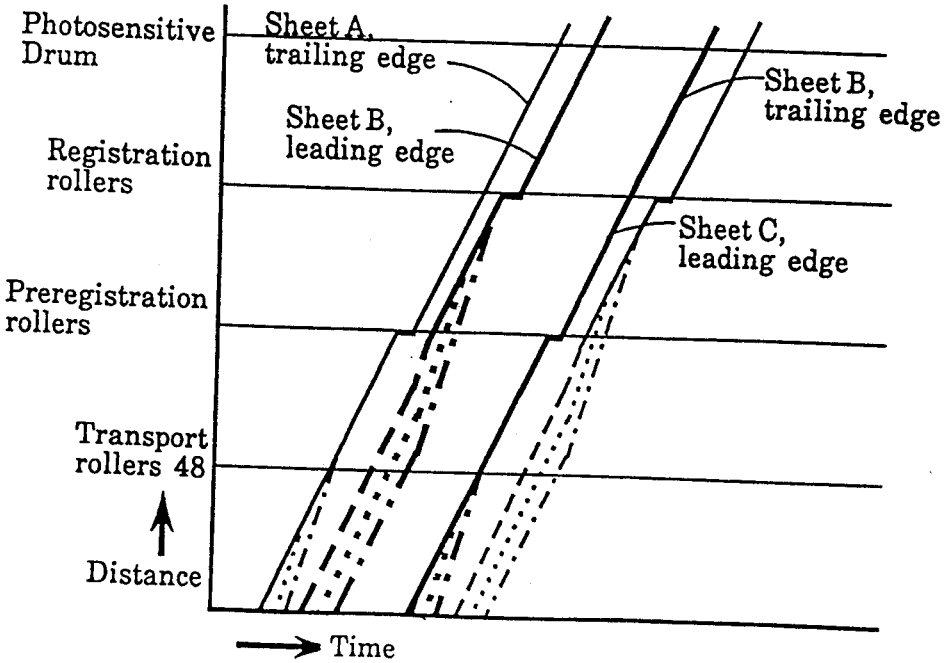

[ FIG.7 ]
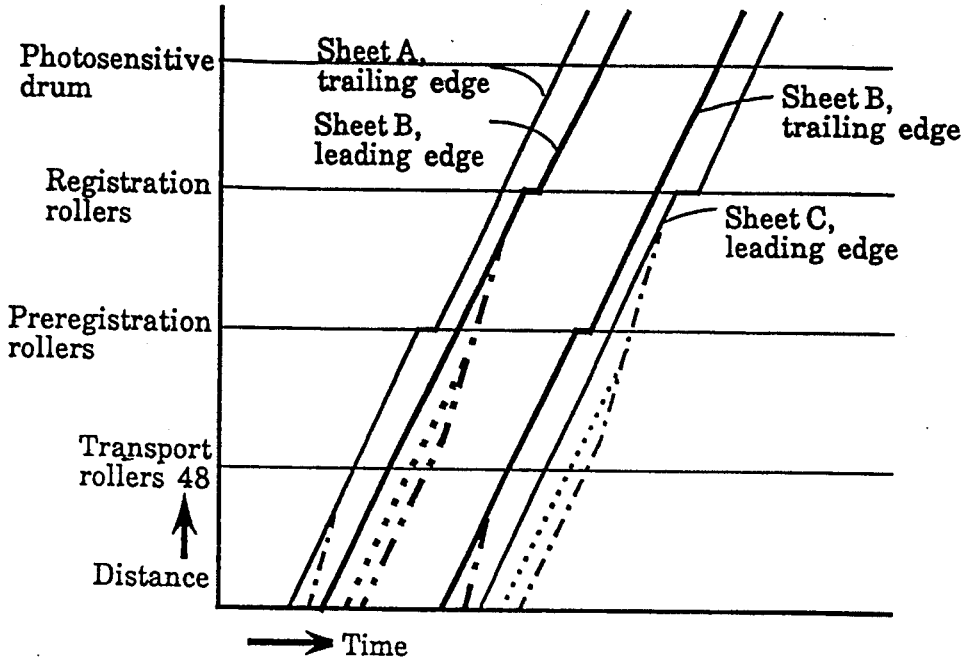
[ FIG.8 ]
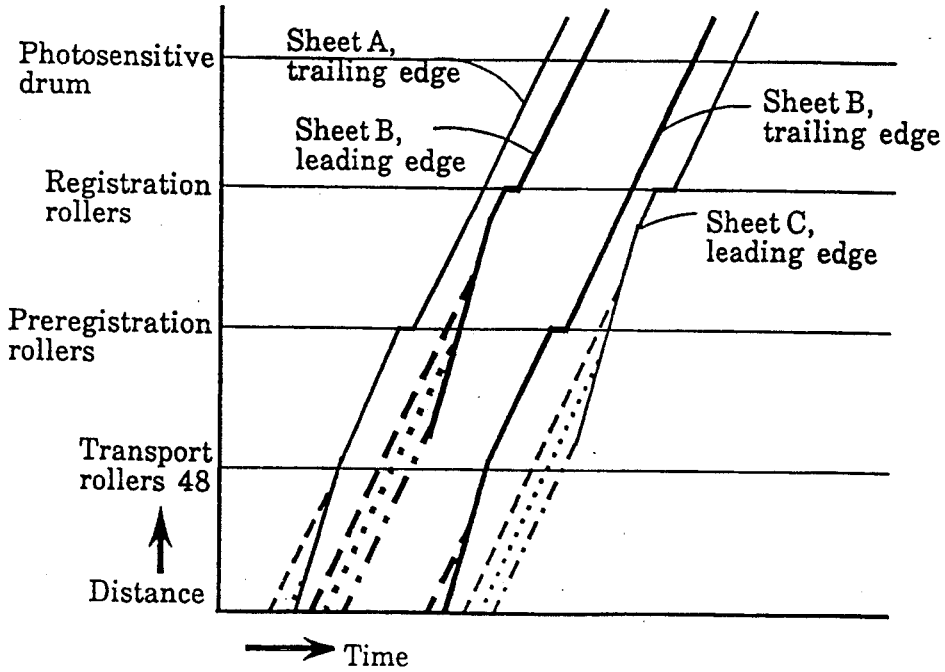

[FIG.9]
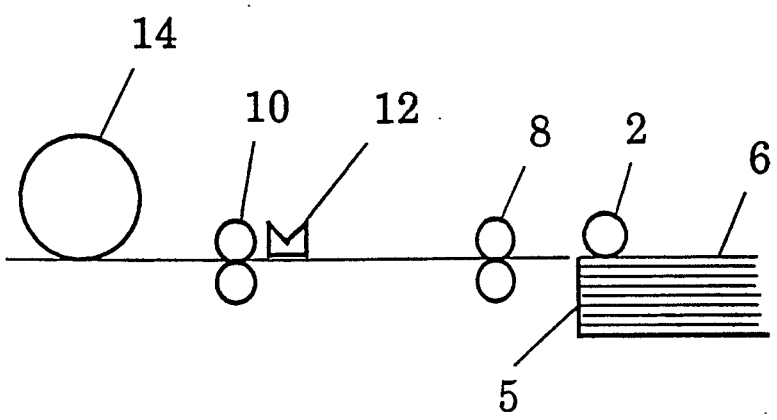
[FIG.10]
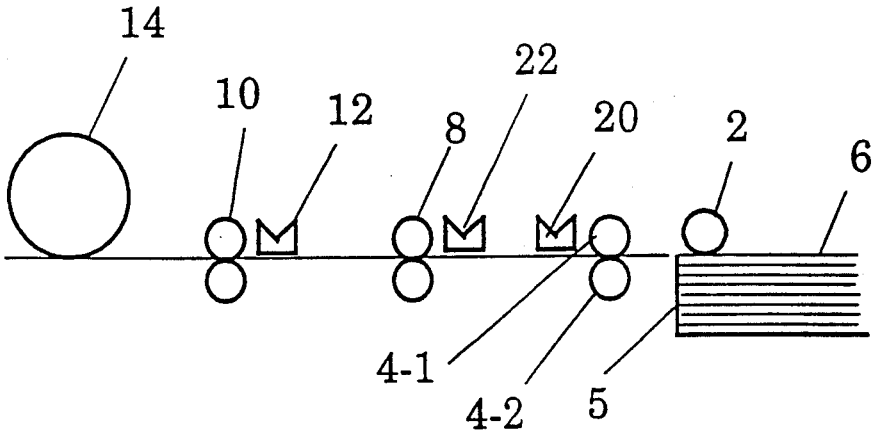

[ FIG.11 ]
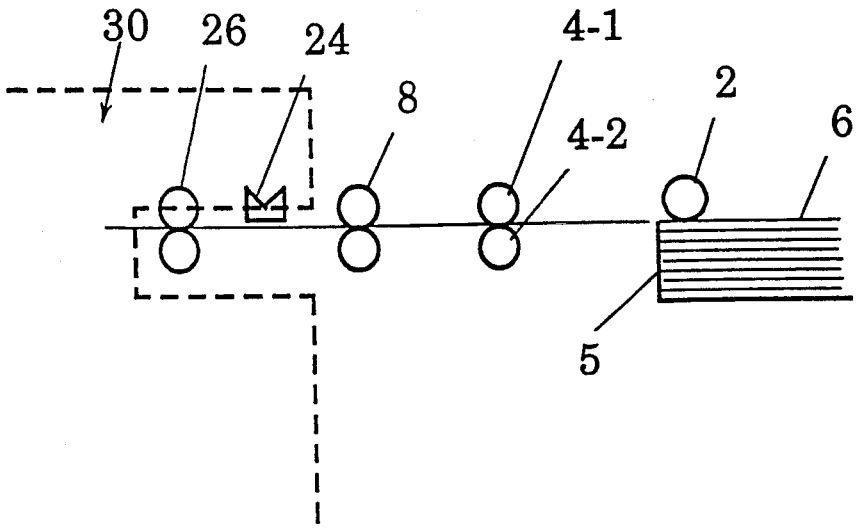

SHEET FEEDER

BACKGROUND OF THE INVENTION

1. Field of the Invention

The present invention relates to a sheet feeder for an image forming apparatus and, more particularly, to a sheet feeder provided with a mechanism for transporting sheets successively at short intervals to an image transfer unit.

2. Description of the Prior Art

In feeding a sheet by a sheet feeder to the photosensitive member of an xerographic image forming apparatus, the sheet is held at a position immediately before the photosensitive member by a registration means to feed the sheet in phase with an image formed on the photosensitive member.

The Sheet feeder shown in FIG. 9 is disclosed in Japanese Patent Laid-open (Kokai) No. Sho 60-77051 (first reference). In this sheet feeder, a feed roller 2 is activated at time $t_1$ to feed out a sheet 6 from a sheet feed tray 5. The feed roller 2 is disengaged from a driving mechanism at time $t_2$, and then the sheet 6 is transported by transport rollers 8. Upon the detection of the passage of the leading edge of the sheet 6 by a sheet detector 12 disposed near a registration rollers 10 at time $t_3$, the time required for the leading edge of the sheet 6 to arrive at the sheet detector 12 after the actuation of the feed roller 2 i.e. $T_d=t_3-t_1$, is calculated. A registration rollers 10 is activated at time $t_4$ to deliver the sheet 6 to a photosensitive drum 14. A time difference $\Delta T=T-T_d$, where T is a standard time in which the leading edge of the sheet 6 should arrive at the registration rollers 10, is calculated and the time $t_1$ the feed roller into action is changed to $t_1+\Delta T$ so that the next sheet 6 arrives at the registration roller 10 at correct time with respect to the angle of the photosensitive drum 14.

In feeding a sheet by a sheet feeder shown in FIG. 10, disclosed in Japanese Patent Laid-open (Kokai) No. Sho 61-51428(1986) (second reference), a feed roller 2 and a sheet separating roller 4-1 are activated in response to a sheet feed signal. Sheet detectors 12, 20 and 22 detect the leading edge of a sheet 6. The feed roller 2 is stopped upon the detection of the leading edge of the sheet 6 by the sheet detector 22. A transport speed $V_1$ at which the sheet 6 has been transported between the sheet detectors 20 and 22 is calculated. The time when transportation of the sheet 6 is to be restarted is determined on the basis of the transport speed $V_1$ and a transport speed $V_2$ at which the preceding sheet 6 was transported between the sheet detectors 22 and 12 by a transport rollers 8; that is, the time when transportation of the sheet is to be restarted is adjusted on the assumption that this sheet 6 will be transported at the transport speed $V_1$ as far as the transport rollers 8, and at the transport speed $V_2$ from the transport rollers 8 to registration rollers 10 so that the sheet 6 arrives at the registration rollers 10 at the predetermined time. An estimated value for the transport speed $V_1$ is used for calculating the time when transportation of the first sheet 6 is to be restarted. Thus, variations in the transport speed due to irregularity in the position of the leading edges of sheets stacked at a sheet stacking position is corrected to reduce gaps between the successive sheets required for compensating the variation of transport speed.

Japanese Patent Laid-open (Kokai) No. Sho 62-136442 (third reference) discloses the multistage sheet feeder shown in FIG. 11.

Referring to FIG. 11, a feed roller 2 and a sheet separating roller 4-1 are activated in response to a sheet feed command to feed out a sheet 6 from a sheet feed tray 5. Next, the sheet 6 is transported to transport rollers 26 of a copying machine 30 by transport rollers 8 capable of rotating at three different transport speeds. A sheet detector 24 disposed near the sheet inlet of the copying machine 30 detects the passage of the leading edge and the trailing edge of the sheet 6. If the sheet feed command requires feeding a plurality of sheets, the gap between the trailing edge of the preceding sheet and the leading edge of the succeeding sheet is calculated on the basis of detection signals provided by the sheet detector 24. If the calculated gap is different from a reference gap, a time gap for which the transport speed is to be changed is determined by calculation on the basis of the difference between the calculated gap and the reference gap, and then the transport speed is changed according to the result of calculation so that the sheets are transported at fixed gaps. The surface speed of the transport rollers is increased for the calculated time gap if the gap between the successive sheets is greater than the reference gap or the surface speed of the transport rollers is decreased for the calculated time gap if the gap between the successive sheets is shorter than the reference gap to feed the sheets at the fixed gaps to the copying machine.

A typical digital image forming apparatus, such as a digital copying machine, converts the image of an original document into digital image signals by a CCD line sensor or the like and stores the digital image signal as image data in a storage device. The image data is converted into light signals to form a latent image corresponding to the image of the original document on a photosensitive drum. Since the same image data can be used repeatedly to produce a plurality of copies of an original document, only a single cycle of the reading operation for reading the image of the original document is necessary to produce a plurality of copies of an original document. Since the digital image forming apparatus does not need any time for returning the image scanning unit to its original position, which is essential to a conventional copying machine with no image storage facility, the image can be written continuously on the photosensitive drum. Accordingly, if the image is written on the photosensitive drum at reduced gaps and the sheets are fed in synchronism with the image writing operation, the throughput of the copying machine, namely, the number of copies produced in a unit time, can be increased.

In some cases, a sheet is fed out from the sheet feed tray with a delay due to slipping of the feed roller relative to the sheet or, if two or more sheets are fed out by the feed roller from the sheet feed tray and one of the sheets is separated and fed by the sheet separating roller, the following sheet is fed out earlier because it is held dislocated from the sheet stacking position in the sheet transporting direction. Since the sheet feed timing thus varies, the prior art has problems that the time when the sheet arrives at the registration means varies and that collisions between successive sheets occur if the sheets are fed at short intervals.

The sheet feeder disclosed in the first reference corrects the timing of feeding out the succeeding sheet on the basis of the transport time required for transporting the preceding sheet. Accordingly, if the preceding sheet and the succeeding sheet are fed out under different feed-out conditions, for example, if the preceding sheet and the succeeding sheet are fed out together and the succeeding sheet is held by the sheet separating roller at a position dislocated from the sheet stacking position, the correction is ineffective and, consequently, the time when the sheet arrives at the registration rollers varies.

Although the sheet feeder disclosed in the third reference is capable of transporting the successive sheets at fixed gaps and of adjusting the gap between successive sheets to the reference gap on the basis of a measured gap, the sheet feeder is unable to control the transportation of the sheet so that the sheet arrives at a predetermined position at a predetermined time.

Accordingly, in feeding sheets successively by these prior art sheet feeders, each sheet must be delayed by the registration means disposed immediately before the photosensitive drum to absorb variations in the time when the sheet arrives at the registration means. Therefore, the sheet is transported by the transport rollers disposed before a registration rollers to bring the leading edge of the sheet into abutment with the registration roller at a stop and to press the sheet against the registration roller so that the sheet is curved for registration, the transport rollers disposed before the registration rollers are stopped, and the sheet is held on standby until the registration rollers are activated in synchronism with the rotation of the photosensitive drum. Since the sheet must be held on standby, it is impossible to feed the sheets at short intervals.

The sheet feeder disclosed in the second reference absorbs variations in the time when the sheet arrives at the registration rollers due to the dislocation of the sheet from the sheet stacking position or variation in the transport speed by temporarily stopping the sheet before the transport rollers. Therefore, the time gap at which the sheets are delivered to the photosensitive drum is dependent on a time gap for which the transportation of the sheet is interrupted and hence the time gap at which the sheets are delivered to the photosensitive drum cannot be reduced below the time gap for which the transportation of the sheet is interrupted. In FIG. 4, distance from a reference point is measured upward on the vertical axis and time is measured to the right on the horizontal axis, thick solid lines indicate the respective positions of the leading edge and the trailing edge of a sheet B, thin solid lines indicate the trailing edge of a sheet A preceding the sheet B and the leading edge of a sheet C succeeding the sheet B, broken lines indicate a sheet fed out at the earliest time, alternate long and short dash lines indicate a sheet fed out at the latest time, a2 is the range of variation in the time when the sheet is fed out, b2 indicates a time gap between the sheets at a position immediately before the registration rollers, c2 is the standby time period for which the sheet is held at the registration rollers for registration and for synchronizing the operation of the registration rollers with that of the photosensitive drum, and d2 (=b2+c2) is a time gap between the trailing edge of one sheet and the leading edge of the next sheet being delivered to the photosensitive drum. Since the sheet is stopped temporarily at a position immediately before the transport rollers to absorb variations in the time when the sheet is fed out, the sheet arrives at the registration rollers at a fixed time regardless of variations in the time when the sheet is fed out. The gap between the successive sheets decreases to a minimum at the position immediately before the transport rollers. If the gap between successive sheets is zero when the successive sheet is fed out the earliest possible time, the time gap b2 is equal to the difference between the range a2 and the standby time c2, and hence the time gap d2 at which the successive sheets are delivered to the photosensitive drum is equal to the range a2; that is, the minimum time gap at which the sheets are delivered to the photosensitive drum is dependent on the maximum transportation interruption time gap, and the minimum time gap cannot be reduced below this maximum transportation interruption time gap.

SUMMARY OF THE INVENTION

Accordingly, it is an object of the present invention to provide a sheet feeder for feeding sheets to the photosensitive drum of an image forming apparatus, such as a copying machine, eliminating the foregoing disadvantages of the prior art sheet feeders and capable of successively feeding sheets at short intervals at predetermined time.

A sheet feeder according to one aspect of the present invention comprises: a sheet feed tray on which sheets are stored; a feed means for feeding out sheets one at a time from the sheet feed tray; a separating means for separating sheets when a plurality of sheets are fed out at a time from the sheet feed tray by the feed means, to feed the sheets one at a time; a transporting means for transporting the sheet delivered from the separating means to a image forming means; a sheet detecting means for detecting the passage of the leading edge of the sheet past a first position in the transporting means; a calculation means which, based on the behavior of a sheet which is fed by the feed means, but is then detained by the separating means, determines a target time at which a sheet should arrive at a second position downstream of said first position, and calculates from the detection result provided by the sheet detecting means the deviation from said target time of the sheet; and control means for varying the sheet transport speed on the basis of the results of calculation made by the calculation means so that the sheet arrives at the second position at the preset desired time.

If a plurality of sheets are fed to the separating means by the sheet feed means, the separating means separates the sheets and delivers the sheets one at a time to the transportation passage. When the preceding sheet is delivered to the transportation passage, the succeeding sheet is detained near the separating means. Therefore, the succeeding sheet is delivered to the transportation passage at time earlier than the time when the sheet fed out from the sheet feed tray is delivered to the transportation passage. The present invention determines beforehand the preset desired time at which the sheet must pass the second position on the basis of the position of the sheet detained by the separating means. The time when the sheet passes the second position is estimated by calculation on the basis of a detection signal provided by the sheet detecting means upon the detection of the passage of the sheet past the first position, and the arithmetic means calculates the difference between the estimated time and the preset desired time. The control means then regulates the sheet transport speed on the basis of the difference calculated by the arithmetic means so that the sheets arrive at the second position successively at predetermined gaps and at a predetermined time in each image forming cycle.

BRIEF DESCRIPTION OF THE DRAWINGS

The above and other objects, features and advantages of the present invention will become more apparent from the following description taken in connection with the accompanying drawings, in which:

FIG. 1 is a schematic sectional view of a copying machine incorporating a preferred embodiment of a sheet feeder according to the present invention;

FIG. 2 is a diagrammatic view of the first embodiment of the sheet feeder according to the present invention;

FIG. 3 is a flow chart illustrating a control algorithm to be executed by the sheet feeder of FIG. 2;

FIG. 4 is a graph illustrating sheet transportation methods by which the sheet feeder of the first embodiment and a prior art sheet feeder transport sheets;

FIG. 5 is a graph illustrating a sheet transportation method by which a sheet feeder of a second embodiment according to the present invention transports sheets;

FIG. 6 is a graph illustrating a sheet transportation method by which a sheet feeder of a third embodiment according to the present invention transports sheets;

FIG. 7 is a graph illustrating a sheet transportation method by which a sheet feeder of a fourth embodiment according to the present invention transports sheets;

FIG. 8 is a graph illustrating a sheet transportation method by which a sheet feeder of a fifth embodiment according to the present invention transports sheets;

FIG. 9 is a diagrammatic view illustrating the operation of a first prior art sheet feeder;

FIG. 10 is a diagrammatic view illustrating the operation of a second prior art sheet feeder; and FIG. 11 is a diagrammatic view illustrating the operation of a third prior art sheet feeder.

DETAILED DESCRIPTION OF THE PREFERRED EMBODIMENTS

First Embodiment:

Referring to FIG. 1, a copying machine 1 comprises an automatic document feed device 2, an image data input device 4, an image data output device 6 and a sheet feeder 8.

The automatic document feed device 2 has a document table 10, a document delivery tray 12, a pair of feed rollers 14, feed belts 16 and a pair of delivery rollers 18. The feed rollers 14 feed originals stacked on the document table 10 one at a time to the feed belts 16, and then the feed belts 16 convey each original to a predetermined position on a glass platen 20. After the image of the original placed on the glass platen 20 has been read by the image data input device 4, the feed belts 16 convey the original to the delivery rollers 18, and then the delivery rollers 18 deliver the original onto the delivery tray 12.

The image data input device 4 has an image pickup unit 22, a wire 24 for moving the image pickup unit 22, and a driving pulley 26 for driving the wire 24. The image pickup unit 22 is provided with a CCD line sensor for converting the image of the document into corresponding digital image signals. The digital image signals are subjected to signal processing processes and the processed digital image signals are transferred to the image data output device 6.

The image data output device 6 has a scanner 30 and a photosensitive drum 31. A charger 32 for uniformly charging the circumference of the photosensitive drum 31, a developing unit 32 for developing an electrostatic latent image into a toner image, a transfer unit 35 for transferring the toner image to a sheet, and a cleaning unit 36 for removing toner remaining on the circumference of the photosensitive drum 31 are arranged around the photosensitive drum 31. The digital image signals provided by the image data input device 4 are converted into corresponding light signals by a laser unit 30*a* included in the scanner 30. The light signals are projected on the circumference of the photosensitive drum through a polygonal rotating mirror 30*b*, an $f/\theta$ lens 30*c* and a mirror 30*d* to form an electrostatic latent image corresponding to the image of the original. The electrostatic latent image is developed in a toner image and the toner image is transferred from the photosensitive drum 31 to a sheet, the toner remaining on the circumference of the photosensitive drum is removed by the cleaning unit 36, and then, the circumference of the photosensitive drum 31 is charged by the charger 32. The toner image transferred to the sheet is fused and fixed to the sheet by a fixing device 38 to complete a copying cycle.

The sheet feeder 8 comprises sheet feed trays 40*a*, 40*b* and 40*c* on which sheets are stored in stacks, feed rollers 42*a*, 42*b* and 42*c* for feeding out sheets one at a time respectively from the sheet feed trays 40*a*, 40*b* and 40*c*, pairs of separating rollers 44*a*, 44*b* and 44*c* for separating sheets and delivering only one sheet at a time when a plurality of sheets are fed out from the corresponding sheet feed trays 40*a*, 40*b* and 40*c*, sheet detectors 46*a*, 46*b* and 46*c* for detecting sheets delivered by the separating rollers 44*a*, 44*b* and 44*c*, respectively, pairs of transport rollers 48*a*, 48*b* and 48*c* for transporting sheets, a pair of preregistration rollers 50, a pair of registration rollers 52 for registration of a sheet and for delivering the sheet to the photosensitive drum 31 in phase with the image formed on the photosensitive drum 31, and a sheet detector 68 disposed near the pair of registration rollers 52 to detect the arrival of a sheet at a predetermined position. As shown in FIG. 2, the feed roller 42*a* and the separating rollers 44*a* are driven by a first motor 60*a* through a clutch 43*a*. The transport rollers 48*a* and the preregistration rollers 50 are driven respectively by a second motor 62*a* and a third motor 64. The second motor 62*a* and the third motor 64 are stepping motors. Although not shown in FIG. 2, the feed rollers 42*b* and 42*c* and the separating rollers 44*b* and 44*c* are driven by first motors 60*b* and 60*c* through clutches 43*b* and 43*c*, respectively, and the transport rollers 48*b* and 48*c* are driven by second motors 62*b* and 62*c*, respectively.

The sheet feeder 8 has a control unit 70. As shown in FIG. 7, the control unit 70 comprises, as principal components, a CPU 72 which executes calculation and issues instructions, a memory 74 for storing data necessary for the operation of the CPU 72, a timer 76 for measuring time, a driver 80 for driving the motors 60 (60*a*, 60*b* and 60*c*), 62 (62*a*, 62*b* and 62*c*), 64 and 66, and the clutches 43 (43*a*, 43*b* and 43*c*), and an I/O port 78 through which information is exchanged between the CPU 72, and the driver 80 and the sheet detectors 46 and 68.

The operation of the CPU 72 will be explained with reference to FIG. 3 in the case that sheets are fed out from the top sheet feed tray 40*a*.

In step 100, the value t of the timer 76 is set to zero and the timer is started. The CPU 72 sets a transport speed $V_1$ in step 101 and gives an instruction to engage the clutch 43a in step 102. In step 103, a query is made to see if the sheet detector 46a has detected a sheet. If the response in step 103 is affirmative, the clutch 43a is disengaged in step 104 and the time when the clutch 43a is disengaged is stored in variable $t_1$ in step 105. In step 106, speed changing time $T_1$ is calculated by using an expression (for example, expression (1)) as a function of time t.

$$T_1=(L-L_1+V_1t_1-V_2T)/(V_1-V_2) \quad (1)$$

where L is the distance between the sheet stacking position and the registration rollers 52, L*a* is the distance between the sheet stacking position and the sheet detector 46a and T is the desired time when the sheet should arrive at the registration rollers 52.

In step 107, a query is made to see if the time $t=T_1$. If the response in step 107 is affirmative, a command is given to change the transport speed to the transport speed $V_2$.

The mechanism of the sheet feeder 8 operates in response to the instructions provided by the CPU 72. The clutch 43a is engaged and the feed roller 42a and the separating rollers 44a are rotated at a surface speed corresponding to the transport speed $V_1$ in step 102 to start feeding sheets. Upon the detection of the sheet by the sheet detector 46a in step 103, the clutch 43a is disengaged in step 104 to make the feed roller 42a and the separating rollers 44a idle so that the sheet is advanced by the transport rollers 48a. At the time $T_1$, the transport speed is changed from $V_1$ to $V_2$ to transport the sheet to the registration rollers 52 at the transport speed $V_2$.

The leading edge of the sheet advanced by the transport rollers 48a meet the stationary registration rollers 52 and arcs, correcting its alignment. Next, the registration rollers 52 delivers the sheet to the photosensitive drum 31 in phase with the image formed on the photosensitive drum 31.

The relation between time and the position of the sheet will be described with reference to FIG. 4, in which distance from the sheet stacking position is measured upward on the vertical axis, the time elapsed after the sheet has been fed out from the sheet stacking position is measured to the right on the horizontal axis, thick solid lines indicate the leading and trailing edges of a sheet B, and thin solid lines indicate the trailing edge of a sheet A preceding the sheet B and for the leading edge of a sheet C succeeding the sheet B. A thick broken line indicates the leading edge of the sheet B when the sheet B is fed out at the earliest time in a range al of variation in the time when the sheet is fed out and a thick alternate long and short dash line indicates the leading edge of the sheet B when the sheet B is fed out at the latest time in the range al. In FIG. 4, bl is the time gap between the sheets A and B, at a position near the registration rollers 52, cl is a standby time gap, and dl (bl+cl) is a time gap between the sheets A and B at a position immediately before the photosensitive drum 31.

The sheet arrives at the registration rollers 52 at the predetermined time in each copying cycle regardless of the time when the sheet is fed out from the sheet feed tray 40a because the transport speed is regulated according to the time when the sheet is fed out from the sheet feed tray 40a. In a period during the transportation of the sheets, the transport speed for transporting the sheet B exceeds that for transporting the preceding sheet A, and hence the gap between the sheets A and B decreases in the period. In principle it is possible to reduce the gap bl between the sheets A and B to zero at a position immediately before the registration rollers 52. Accordingly, the minimum time gap between sheets is equal to the time gap c2 required for curving the sheet for alignment, whereas, as mentioned above, the prior art sheet feeder is unable to reduce the gap between sheets below the sum of the range a2 of variation in the time when the sheet is fed out and the standby time gap c2 for timing the delivery of the sheet to the photosensitive drum and for aligning.

In the first embodiment, shown in FIG. 4, the transport speed is changed once, but this is not limiting characteristic of the present invention. Other embodiments are illustrated in FIGS. 5, 6, 7 and 8.

Second Embodiment:

Referring to FIG. 5, the sheet is transported at a transport speed $V_1$ in the initial stage of transportation, the transport speed is changed from $V_1$ to $V_2$, which is higher than the transport speed $V_1$, at preset time $t_0$, and then the transport speed is changed again from $V_2$ to $V_1$ in the final stage of transportation at time $T_1$ determined by calculation. A sheet which has been detained by the separating rollers 44a is transported at the transport speed $V_1$ throughout.

Third Embodiment:

Referring to FIG. 6, the sheet is transported at a transport speed $V_1$ in the initial stage of transportation, the transport speed is changed from $V_1$ to $V_2$, which is higher than the transport speed $V_1$, at preset time $t_0$, and then the transport speed is changed again from $V_2$ to $V_1$ in the final stage of transportation at time $T_1$ determined by calculation. Each sheet has a period in which it is transported at the transport speed $V_2$.

Fourth Embodiment:

Referring to FIG. 7 the sheet is transported at a transport speed $V_1$ in the initial stage of transportation, the transport speed is changed from $V_1$ to $V_2$, which is higher than $V_1$, at time $T_1$ determined by calculation, and then the transport speed is Changed again from $V_2$ to $V_1$ in the final stage of transportation at preset time $t_0$. A sheet which has been detained by the separating rollers 44a is transported at the transport speed $V_1$ throughout.

Fifth Embodiment:

Referring to FIG. 8, the sheet is transported at a transport speed $V_1$ in the initial stage of transportation, the transport speed is changed from $V_1$ to $V_2$, which is higher than $V_1$, at time $T_1$ determined by calculation, and then the transport speed is changed again from $V_2$ to $V_1$ in the final stage of transportation at preset time $t_0$. All the sheets have a period in which they are transported at the transport speed $V_2$.

The transportation speed may be regulated for continuously variable speed change instead of changing the same stepwise.

Although the registration rollers are rotated intermittently so that the sheet may be delivered to the photosensitive drum in phase with the image formed on the photosensitive drum in the foregoing embodiments, it is also possible to replace the registration rollers by continuously rotating rollers and effect the registration by for example a gate disposed immediately before the rollers and to deliver the sheet to the photosensitive drum by opening the gate in synchronism with the rotation of the photosensitive drum.

The rotation rate of the registration rollers may be changed in a plurality of steps to absorb the effects of variations in the time when the sheet is fed out. In such a case, the surface speed of the registration rollers and the time when the surface speed of the registration rollers is to be changed are determined by calculation on the basis of the time when the sheet arrives at the registration roller so that the sheet can be delivered to the photosensitive drum in phase with the image formed on the photosensitive drum.

Although the invention has been described in its preferred embodiments with a certain degree of particularity, obviously many changes and variations are possible therein. It is therefore to be understood that the present invention may be practiced otherwise than as specifically described herein without departing from the spirit and scope thereof.

What is claimed is:

1. A sheet feeder comprising:

a sheet feed tray on which sheets are stored;

a feed means for feeding out sheets one at a time from the sheet feed tray;

a separating means for separating sheets when a plurality of sheets are fed out at a time from the sheet feed tray by the feed means, to feed the sheets one at a time;

a transporting means for transporting the sheet delivered from the separating means to a image forming means;

a sheet detecting means for detecting the passage of the leading edge of the sheet past a first position in the transporting means;

a calculation means which, based on the behavior of a sheet which is fed by the feed means, but is then detained by the separating means, determines a target time at which a sheet should arrive at a second position downstream of said first position, and calculates from the detection result provided by the sheet detecting means the deviation from said target time of the sheet; and control means for varying the sheet transport speed on the basis of the results of calculation made by the calculation means so that the sheet arrives at the second position at the preset desired time.

2. A sheet feeder according to claim 1, wherein said control means includes a regulating means for regulating sheet transport speed.

3. A sheet feeder according to claim 2, wherein said regulating means regulates the sheet transport speed of said feed means.

4. A sheet feeder according to claim 2, wherein said regulating means regulates the sheet transport speed of said separating means.

5. A sheet feeder according to claim 2, wherein said regulating means regulates the sheet transport speed of said transporting means.

6. A sheet feeder according to claim 2, wherein said regulating means changes the sheet transport speed stepwise between two sheet transport speeds.

7. A sheet feeder according to claim 6, wherein said control means controls the means relating to the transportation of sheets so that the sheet is transported at a first transport speed in the initial stage of transportation and at a second transport speed lower than the first transport speed in the final stage of transportation.

8. A sheet feeder according to claim 6, wherein said control means controls the means relating to the transportation of sheets so that the sheet is transported at a first transport speed in the initial stage of transportation, at a second speed higher than the first speed int he middle stage of transportation and at the first speed in the final stage of transportation.

9. A sheet feeder according to claim 2, wherein said regulating means regulates the sheet transport speed at a continuously variable speed.

10. A sheet feeder according to claim 1, wherein said transporting means comprises a registration means for delivering a sheet to the photosensitive means in phase with an image formed on the photosensitive means, and a preregistration means disposed upstream of the registration means; the distance between the nip line of the registration means and that of the preregistration means is shorter than the length of a sheet of a minimum size; the preregistration means is rotated continuously during sheet transporting operation; and said control means controls said registration means so that the sheet is delivered tot he photosensitive means after detaining the sheet for a time gap necessary for registration.

* * * * *

UNITED STATES PATENT AND TRADEMARK OFFICE

CERTIFICATE OF CORRECTION

PATENT NO. : 5,197,726

DATED : March 30, 1993

INVENTOR(S) : Yutaka NOGAMI

It is certified that error appears in the above-indentified patent and that said Letters Patent is hereby corrected as shown below:

Claim 1, column 9, line 27, change "a" to -- an--.

Claim 8, column 10, line 26, change "int he" to -- in the--.

Claim 10, column 10, line 43, change "tot he" to -- to the--.

Signed and Sealed this

First Day of March, 1994

Bruce Lehman

*Attest:*

BRUCE LEHMAN

*Attesting Officer*

*Commissioner of Patents and Trademarks*